US006661320B1

(12) United States Patent
Fausch

(10) Patent No.: US 6,661,320 B1
(45) Date of Patent: Dec. 9, 2003

(54) RELAY

(75) Inventor: Werner Fausch, Buchs (CH)

(73) Assignee: Elesta Relays GmbH (CH)

( * ) Notice: Subject to any disclaimer, the term of this patent is extended or adjusted under 35 U.S.C. 154(b) by 0 days.

(21) Appl. No.: 09/769,618

(22) Filed: Jan. 24, 2001

(30) Foreign Application Priority Data

Jan. 28, 2000 (CH) ..... 0172/00

(51) Int. Cl.[7] ..... H01H 67/02
(52) U.S. Cl. ..... 335/129; 335/130; 335/83
(58) Field of Search ..... 335/78–84, 124, 335/128–131, 202

(56) References Cited

U.S. PATENT DOCUMENTS

| | | | | |
|---|---|---|---|---|
| 3,509,502 A | * | 4/1970 | Maynard et al. | 335/131 |
| 3,555,230 A | | 1/1971 | Deck | |
| 5,053,756 A | * | 10/1991 | Wehrle et al. | 335/274 |
| 5,568,108 A | | 10/1996 | Kirsch | |
| 5,831,502 A | * | 11/1998 | Kirsch | 335/129 |
| 6,034,582 A | | 3/2000 | Fausch | |
| 6,081,177 A | | 6/2000 | Fausch | |

FOREIGN PATENT DOCUMENTS

| | | |
|---|---|---|
| AT | 379254 B | 4/1985 |
| AT | 379254 | 12/1985 |
| DE | 2219315 A | 11/1973 |
| DE | 2817036 | 10/1979 |
| DE | 19540739 A1 | 1/1997 |
| DE | 19600314 A1 | 7/1997 |
| DE | 19816878 A1 | 10/1999 |
| EP | 0938119 A1 | 8/1999 |
| EP | 0938120 A1 | 8/1999 |
| EP | 0954001 A1 | 11/1999 |
| FR | 2423855 | 11/1979 |
| FR | 2612685 A | 9/1988 |
| WO | WO 92/21133 | 11/1992 |

OTHER PUBLICATIONS

Search Report for Swiss Patent Application No. 2000 0172/00.
Search Report for Swiss Patent Application No. 2000 0648/00.

* cited by examiner

*Primary Examiner*—Lincoln Donovan
(74) *Attorney, Agent, or Firm*—Wiggin & Dana LLP; William A. Simons; Michael K. Kinney

(57) ABSTRACT

A safety relay comprising an electrically insulating carrier part, an electromagnetic drive arranged on the carrier part, at least one control contact arranged on the carrier part, at least three load contacts arranged on the carrier part wherein each of the load and control contacts is forcibly guided by a common comb connected with the electromagnetic drive and each load and control contact having two contact springs, each of the contacts springs comprising, a contact head, a spring foot at a distance from the contact head, and at least one fastener part connected with the spring foot, the contact springs being supported solidly with the spring foot in the carrier part wherein at least one of the contacts forms a working contact and another one a resting contact, a rigid stop arranged on the carrier part next to which is located the contact head in the vicinity of one of the contact springs, the other one of the contact springs of the contact engaging the comb in such a way that the movement of the contact spring is mechanically linked with the movements of the comb, at least one insulating dividing wall for separating the contact springs of the load contacts the insulating dividing wall reaching from the spring foot at least to the vicinity of the contact head and extending from one side to the other of the safety relay wherein the dividing wall has an offset on the sides bent in opposite directions, and a continuous separating wall embracing the adjacent contact springs of the load contacts formed by the bent offsets connecting the dividing wall with one of the adjacent dividing walls such that the dividing walls and the offsets form a continuous separating wall.

12 Claims, 2 Drawing Sheets

RELAY

BACKGROUND OF THE INVENTION

1. Field of the Invention

The invention concerns a relay and more particularly a safety relay with an electrically insulating carrier part and an electromagnetic drive arranged on the carrier part, at least one control contact and at least three load contacts, both the load and control contacts being forcibly guided. In such a relay, the contacts are individually comprised of two essentially parallel, flat contact springs, each spring comprising a contact head, a spring foot at a distance to the contact head and at least one fastener part connected to the spring foot, for example one or two pins. The spring feet of the contact springs are rigidly fixed on the carrier part. The invention also concerns a three-phase supply network capable of being switched by such a safety relay and the circuitry associated with such a safety relay.

2. Brief Description of Art

As used herein, the term "forcibly guided" refers to the property of being linked by a common movable comb. Therefore, a forcibly guided relay is one in which the contacts are mechanically linked by a common movable comb, connected with the drive and in which at least one working contact and one resting contact are provided. In such a relay, one of the contact springs of each contact is next to a fixed stop in the vicinity of the head, and the other contact spring is engaged in such a way in the comb that it is mechanically linked to the movements of the comb. In this way, it is assured that if a contact is welded, either this contact is broken, or the comb cannot be moved and thus the other contacts must remain in the position produced by the welded contact.

The term "safety relay" means a relay in accordance with standard EN (European Standard) 50205. In a safety relay according to standard EN 50205, the air paths and leakage paths between the control contact and the load contact correspond to the requirements of standard IEC 61810-5 and IEC 664-1. The contents of these standards incorporated in their entirety herein by reference.

For switching electric devices consuming electrical current wherein a high safety standard must be met, two safety relays and two downstream-connected contactors are used. Examples of such current consumers include three-phase current motors. Such circuitry is appropriate for devices having loads, for example, of more than 6 kW. However, devices with loads of approximately 1 to 4 kW are also connected in the described manner and the contactor used therein would be suitable for significantly greater loads. Three-phased motors with a load current, for example, of 5.6 A (constant current) and a switching-on peak-current of approximately 40 A cannot be switched with known safety relays without the provision of an overdimensioned contactor. This requires a nonnegligible expenditure for wiring. In such wiring, each relay and contactor is a relatively expensive part in the production of the circuitry and represents separate possible sources of error.

BRIEF SUMMARY OF THE INVENTION

It is the object of the present invention to increase the safety of switching current, such current switching relative to three-phase mains current, while reducing the structural volume of the required parts. For this purpose, in particular, the number of parts for switching and the possible sources of error in the circuit of current consumers, especially of short-circuit-resistant, three-phase electric motors of 1 to 4 kW power, will be reduced. In addition, a forcibly guided relay will be created, which is designed for voltages of more than 110V or 250V, particularly the 200 or 400V relative voltage between phases that occurs in three-phase mains current, that fulfills the requirements of a safety relay with forcibly guided contacts.

A reduction in the number of parts and a reduction in the number of error sources will be resolved according to the invention by using a forcibly guided safety relay for switching the three phase circuit of a three-phased mains voltage connected to the three load contacts. Appropriately, two relays connected in series are used for the synchronous switching of the three phases in the two relays. By the use of the relay for the direct switching of the consumer current, two contactors connected downstream to the relay and the corresponding wiring of the contactors can be dispensed with. The reduction in the number of parts is accompanied by a reduction in possible sources of error. The double design of the relay serves for safety. It is immaterial whether the two relays are connected in series or if one double relay is utilized.

In a circuit for a three-phase main-current consumer, particularly a short-circuit-resistant electric motor with a forcibly guided safety relay, the three phases of the mains current are connected to the load contacts of the safety relay according to the invention. Here also, for purposes of safety, two safety relays connected in series as two separate relays or together in the form of a double relay are appropriately provided.

Accordingly, one aspect of the invention is drawn to a safety relay comprising an electrically insulating carrier part, an electromagnetic drive arranged on the carrier part, at least one control contact arranged on the carrier part, at least three load contacts arranged on the carrier part. Each of the load and control contacts is forcibly guided by a common comb connected with the electromagnetic drive and has two contact springs, each of the contact springs comprising, a contact head, a spring foot at a distance from the contact head, and at least one fastener part connected with the spring foot. The contact springs are supported solidly with the spring foot in the carrier part. At least one of the contacts forms a working contact and another one a resting contact. A rigid stop is arranged on the carrier part next to which is located the contact head the rigid stop being in the vicinity of one of the contact springs, the other one of the contact springs of the contact engaging the comb in such a way that the movement of the contact spring is mechanically linked with the movements of the comb. At least one insulating dividing wall for separating the contact springs of the load contacts is reaching from the spring foot at least to the vicinity of the contact head and extending from one side to the other of the safety relay. The dividing wall has an offset on the sides bent in opposite directions. A continuous separating wall embracing the adjacent contact springs of the load contacts is formed by the bent offsets connecting the dividing wall with one of the adjacent dividing walls such that the dividing walls and the offsets form a continuous separating wall.

A second aspect of the invention is drawn to a three-phase supply network that comprises at least one safety relay to switch the three phases of the supply network. The relay comprising an electrically insulating carrier part, an electromagnetic drive arranged on the carrier part, at least one control contact arranged on the carrier part, at least three load contacts arranged on the carrier part. Each of said three load contacts is connected to one of said three phases and each of the load and control contacts is forcibly guided by a common comb connected with the electromagnetic drive. Each load and control contact has two contact springs, each of the contacts springs comprising, a contact head, a spring foot at a distance from the contact head, and at least one fastener part connected with the spring foot. The contact springs are supported solidly with the spring foot in the carrier part. At least one of the contacts forms a working contact and another one a resting contact. A rigid stop is arranged on the carrier part next to which is located the contact head. The rigid stop being in the vicinity of one of the contact springs, the other one of the contact springs of the contact engaging the comb in such a way that the movement of the contact spring is mechanically linked with the movements of the comb.

A third aspect of the invention is drawn to an electrical circuit for switching a three-phase main-current consumer the three phases of the current supply network being connected to three load contacts of a safety relay comprising an electrically insulating carrier part, an electromagnetic drive arranged on the carrier part, at least one control contact arranged on the carrier part, and at least three load contacts arranged on the carrier part. Each of the load and control contacts is forcibly guided by a common comb connected with the electromagnetic drive and has two contact springs. Each of the contact springs comprises a contact head, a spring foot at a distance from the contact head and at least one fastener part connected with the spring foot. The contact springs are supported solidly with the spring foot in the carrier part. At least one of the contacts forms a working contact and another one a resting contact. A rigid stop is arranged on the carrier part next to which is located the contact head. The rigid stop being in the vicinity of one of the contact springs, the other one of the contact springs of the contact engaging the comb in such a way that the movement of the contact spring is mechanically linked with the movements of the comb.

A forth aspect of the invention is drawn to a process for switching the three phases of a three-phase supply network, the three phases being switched by a safety relay comprising an electrically insulating carrier part, an electromagnetic drive arranged on the carrier part, at least one control contact arranged on the carrier part, and at least three load contacts arranged on the carrier part. Each of the load contacts is connected to one of the three phases. Each of the load and control contacts is forcibly guided by a common comb connected with the electromagnetic drive and has two contact springs, each of the contacts springs comprising, a contact head, a spring foot at a distance from the contact head and at least one fastener part connected with the spring foot. The contact springs are supported solidly with the spring foot in the carrier part. At least one of the contacts forms a working contact and another one a resting contact. A rigid stop is arranged on the carrier part next to which is located the contact head. The rigid stop being in the vicinity of one of the contact springs, the other one of the contact springs of the contact engaging the comb in such a way that the movement of the contact spring is mechanically linked with the movements of the comb.

Preferably, in a relay of the present invention, the individual contact springs of the load contacts are separated from one another by an insulating dividing wall reaching from the spring foot to at least the vicinity of the contacthead and extending from one side of the relay to the other. The dividing wall is bent in opposite directions on the sides and each bent part is connected with another of two adjacent dividing walls. In this way, the dividing walls and the bent parts together form a continuous separating wall meandering about the contact springs of the load contacts. With this constructive measure, the prerequisites for a constricted space with respect to leakage paths between the load contacts can be fulfilled, since the leakage paths between the spring feet of the contact springs of adjacent contacts extend around a bent part. The meandering is achieved by two cast shapes with opposite gearing. These shapes can be separated and again combined by a translation crosswise to the direction of movement of the comb.

Preferably, the contact springs of the control contacts have a smaller cross section than those of the load contacts. This results in a savings of material and space for the control contacts. In other words, the cross-sections of the springs of the load contacts are larger than those of the control contacts. This configuration allows for higher current flow with less resultant heating of the springs of the load contacts. In addition, the spring force of the springs of the load contacts is greater and thus the force for loosening the contact is increased and thus greater weldings of the contact heads can be loosened, than in the case of smaller spring cross sections.

The contact springs of the load contacts are appropriately arranged one behind the other in a linear row in the direction of motion of the comb and take up the same width as two control contacts next to one another. Such an arrangement permits simple control of the contact springs with a common comb.

Advantageously, the stop for the contact springs, which are not engaged with the comb, is formed by a lip at the dividing wall between the contact springs of a contact. Owing to the bent parts, the dividing wall is very stiff and is able to withstand forces even in a heated state, to reliably retain the contact spring. The stop can be formed on one or the other of the two geared cast forms according to an example of embodiment. In this way, various combinations of resting and working contacts can be achieved by slight changes in the cast shape.

Preferably the planar dividing wall between the contact springs of different contacts reaches up between the contact heads. Thus, a chamber system is formed for each individual contact spring by the dividing walls which assures a secure separation of the contacts from one another even in the case of increased contamination by any burnt-off material of the contact heads. The planar dividing wall between two adjacent contacts extends beyond the contact heads in order to lengthen the air path between these contacts.

In a preferred embodiment of the invention, cross-pieces are formed on the comb between the contact head at the contact spring engaging in the comb and the dividing wall between two contacts. The cross-pieces are aligned parallel to the dividing wall. They also lengthen the air path between adjacent contact springs of different contacts. Due to the crosspieces, a minimum structural height of the relay and, at the same time, the desired path elongation of the air path between the ends of adjacent contact springs of different contacts on the head side are achieved.

The planar dividing walls between the contact springs of the same contact and the bent parts are preferably of equal height. Bent parts of lower height would adversely affect the stiffness of the dividing wall, while greater heights would impede the view onto the contact heads.

Advantageously, in the case of the contact springs of the load contacts, the spring foot is displaced laterally with respect to the contact head such that the fastener parts of the two contact springs of one load contact are arranged at opposite edges of the carrier part, but the heads are arranged in between at a central line. The fastener parts of adjacent contact springs thus are arranged at the opposite edges of the relay. The fastener parts on the same end of the relay are arranged at double the spring distance. By this construction, even though the relay is built very compactly, the required and prescribed safety distances between the fastener parts are met. Preferably, the spring feet are arranged near the open side of the chamber system so that slots for receiving the contact springs provided in the carrier part cut to as small a depth as possible. The load contacts advantageously each have two fastener parts, in order to have double the connection surface with a connection part, e.g., a printed-circuit board or a relay plug, as compared to springs with only one fastener part.

Advantageously, the control contacts are arranged next to one another with reference to the direction of motion of the comb and are separated by a planar partition wall extending in the direction of motion of the comb. With this space-saving configuration a chamber system is achieved that ascertains a sufficient separation of the contacts. In an even smaller construction, but still providing for a sufficient separation of the contacts, the comb is provided with an elongated opening, the partition wall extending through this opening with its comb-side edge. Having the partition wall forked on its comb-side edge allows for an even more compact construction. The forking forms a channel which extends lengthwise to the direction of motion of the comb. A covering is provided having a rib which extends into the channel and between the forking. With this construction, a labyrinthine elongation of the air path between two control contacts is achieved, which in turn permits a minimal structural height of the relay. Even when the contact springs of the load contacts are also bent relative to their fastener part-contact head axis, so that the contact head is arranged at a central line and the two fastener parts on one or the other edge of the carrier part, the contacts springs of the load contacts are still essentially planar and of the same configuration. The contact springs differ only by the length of an end portion on the head side projecting over the contact head such that the active contact springs engage with their long end portions into the comb, but the passive contact springs with their short end portions do not.

DETAILED DESCRIPTION OF THE INVENTION

Figure 1:
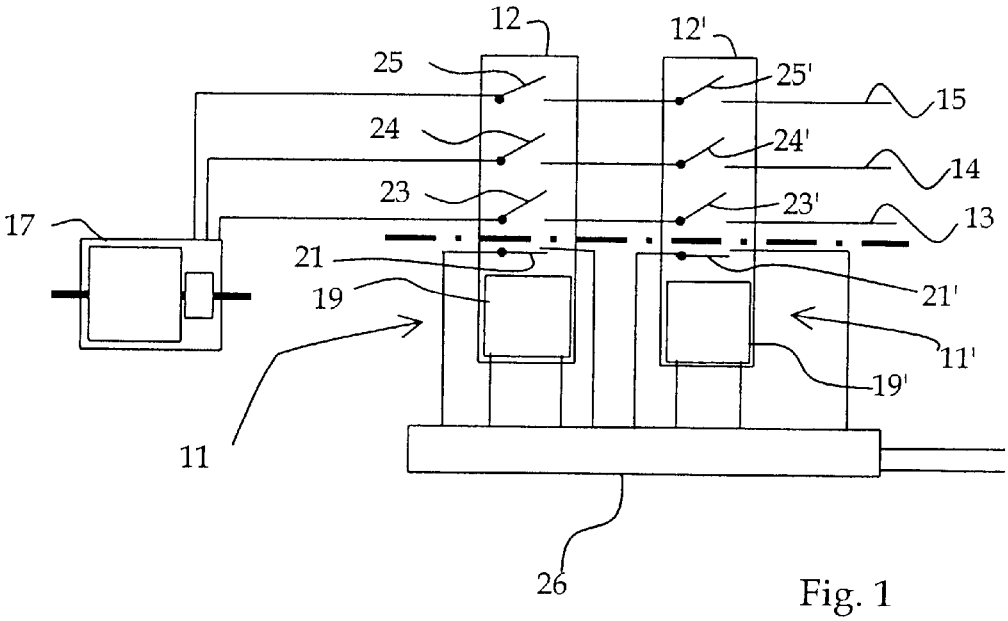
FIG. 1 is a circuit diagram with an electric motor connected according to the invention.
Figure 2:
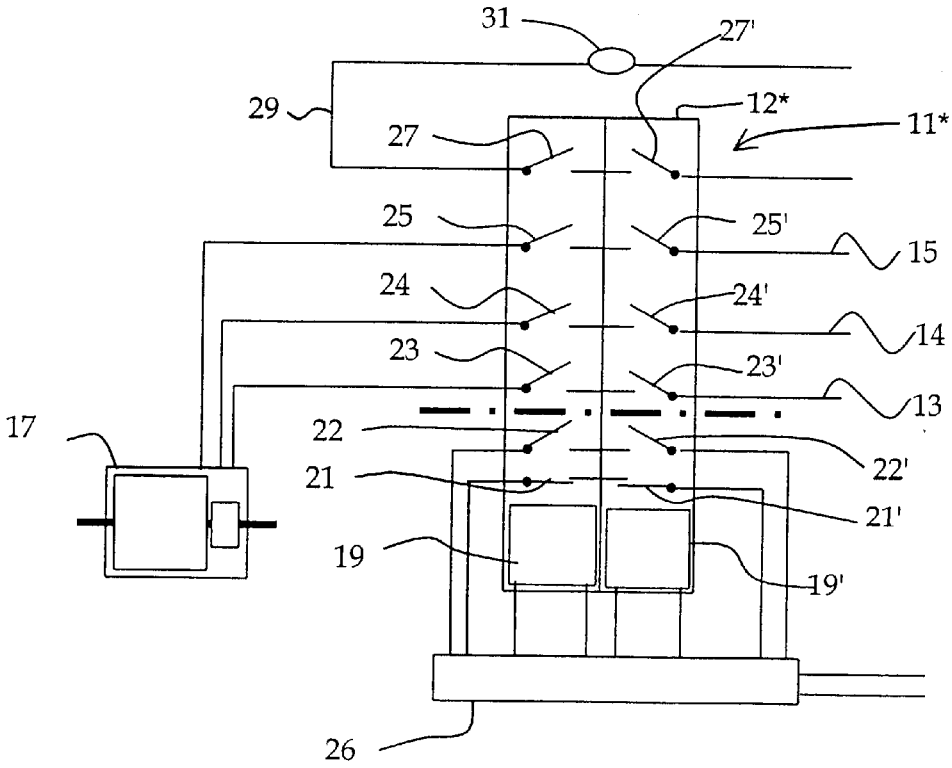
FIG. 2 is a circuit diagram comprising a twin relay with additional contacts according to the invention.

In FIGS. 1 and 2, there are illustrated two relays 11, 11' connected in series and a twin relay 11* with which the three phases 13, 14, 15 of an electrical main supply are switched, in order to reliably connect a three-phase current motor 17. Such circuitry can be used, for example, in the safety monitoring of a press, a cutting machine or the like, or to connect to a light curtain monitoring a danger area.

In a carrier part 12, 12' the relays 11, 11' each comprise a drive 19, 19', a control contact 21, 21' and three load contacts 23, 24, 25 or 23', 24', 25'. The load contacts are not connected to a control current for controlling a contactor, but they are connected directly with the three phases of an alternating-current supply network, each phase having the typical voltages of three phase current supply networks, such as, for example, approximately 230 volts or 110 volts nominal voltage, and approximately a 400 volt or 200 volt difference in voltage between the phases, respectively. Control contact 21, 21' is placed, for example, under 12 or 24 volts. The separation of load contacts 23, 24, 25 or 23', 24', 25' relative to one another is designed for 400 volts in the present example. The separation between the load contacts 23, 24, 25 or 23', 24', 25' and the control contacts 21, 21' corresponds to the width of double or reinforced insulation. For this purpose, for example, a known relay with 10 contacts of the SIR series of the applicant could be used in which alternatively on one or the other side of the separating wall that separates five contacts from the other five contacts every second contact is individually connected with one of the three phases.

The relays are activated and deactivated by monitor or control unit 26. A pulse or control current evoked, for example by interrupting a light beam of a light curtain, triggers in the known way the switching of relay 11, 11'. If, for example, a contact 23 of relay 11 should not open when relay 11 is deactivated, then it is ascertained that the upstream contact 23' of relay 11' opens and as a result the current supplied to phase 13 is interrupted. The control of the relays 11, 11' prevents the activation of relays 11, 11' in the case of a different switching state thereof. The different switching state is established on the basis of the forcibly guided (mechanically linked) control contacts 21, 21'.

With reference to FIG. 2 there is illustrated in an analogous manner a circuit diagram for a double relay 11*. Several pairs of internally connected load contacts 23, 24, 25 or 23', 24', 25' and control contacts 21, 22, or 21', 22' and two separate drives 19, 19' are arranged on a carrier part 12*. Additionally, a second control contact 22, 22' and a fourth load contact 27, 27' are provided. For example, a fourth wire (neutral conductor) can also be interrupted or a line 29 with a control light 31, for example, can be connected by means of the additional load contact 27, 27'.

Figure 3:
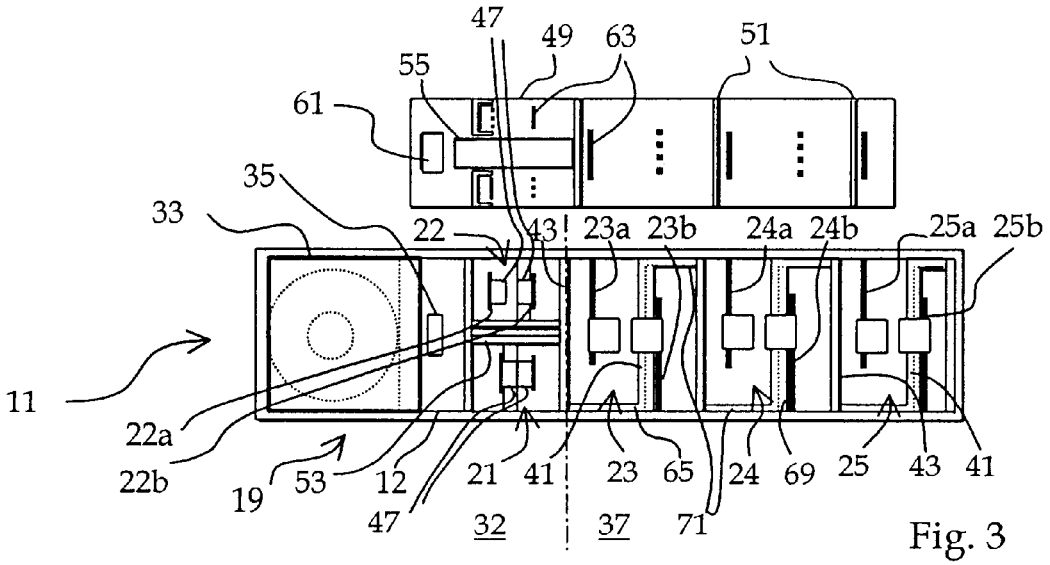
FIG. 3 is a top plan view of a relay according to the invention showing also the comb of the relay from underneath.
Figure 4:
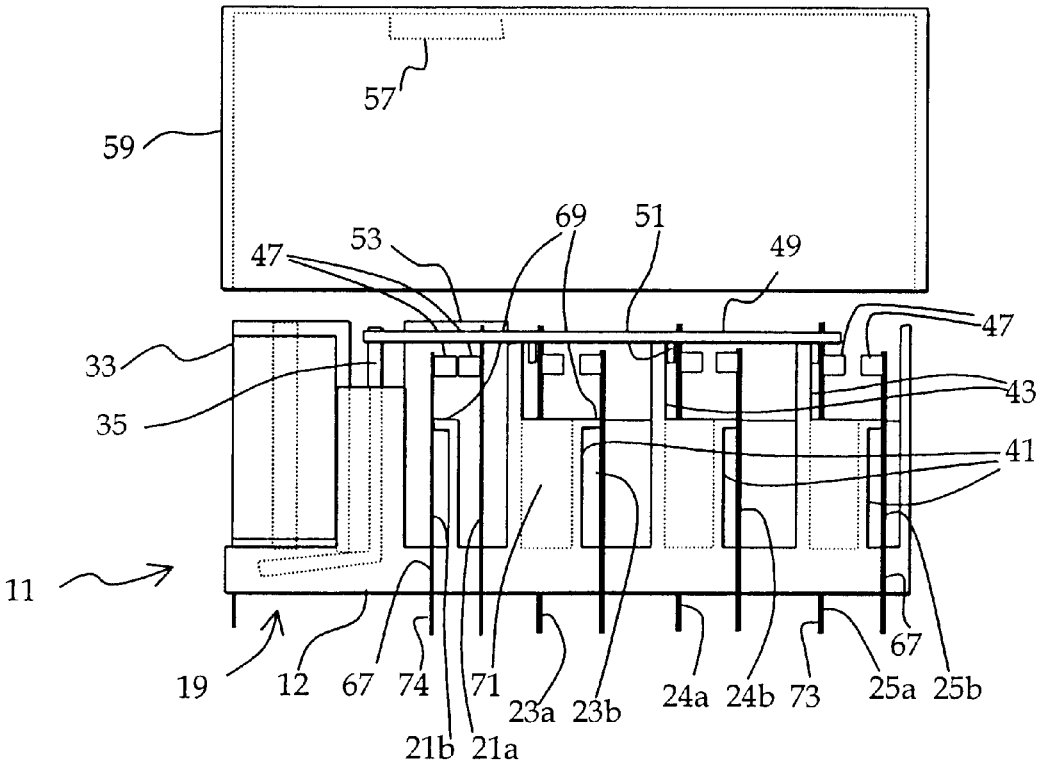
FIG. 4 is a side view of the relay according to FIG. 3 with a cover cap.

FIG. 3 shows a relay 11 particularly suitable for a circuit according to FIG. 1. Drive 19, essentially comprised of an electromagnet 33 with a toggle armature 35, and two control contacts 21, 22 are accommodated on a control side 32 of relay 11 in a carrier part 12. Three load contacts 23, 24, 25 are arranged on a load side 37. Contact springs 23*a* and 23*b*, 24*a* and 24*b* or 25*a* and 25*b* each form together a contact 23, 24, 25. Each contact spring is separated from the others by a dividing wall 41, 43. The dividing wall 41 is arranged between two springs of a contact, such as between contact springs 23*a* and 23*b*. As shown in FIG. 4 the height of the dividing wall is shorter than the length of the contact spring between its clamping region 67 and its contact head 47. The higher dividing walls 43 each are arranged between two contact springs of different contacts, such as 24*b* and 25*a*, and extend beyond the contact heads 47. Comb 49 lies on the higher dividing wall 43. Ribs 51, which extend over the entire width of the comb 49, are formed on comb 49, overlapping with the high dividing walls 43 and parallel to them. These ribs 51 together with dividing walls 43 elongate the air path between the different load contacts 23, 24, 25.

Between two control contacts 21, 22 a partition wall 53 is formed. The partition wall 53 is arranged perpendicularly to the dividing walls 41, 43 and separates control contacts 21, 22. At its upper end, i.e., in the neighborhood of contact heads 47 of control contacts 21, 22 the partition wall is formed of two layers with an intermediate space between the two layers. This two-layered portion of the partition wall 53 extends through an opening 55 in comb 49 and, when the relay housing is closed, is engaged with a rib 57 at a preferably transparent relay hood 59, as it is illustrated in FIG. 4. An opening 55 for the partition wall 53 and an engagement opening 61 for the armature 35 are provided in the comb 49. Also, slots 63 are provided for active contact springs 21*a*, 22*a*, 23*a*, 24*a*, 25*a* engaged with comb 49. The positions of the other, passive contacts springs 21*b*, 22*b*, 23*b*, 24*b*, 25*b* are depicted by dotted lines. Slots can be provided also in these places. This permits the use of the same comb 49 for other arrangements of resting and working contacts.

As is illustrated with reference to FIGS. 3 and 4 the separating wall 65 forms a single chamber with a rectangular undulating line for the individual contact springs 23*a*, 23*b*, 24*a*, 24*b*, 25*a*, 25*b* of the load contacts. In a top plan view the separating wall 65 is in the region of the control contacts basically formed like an "H", wherein one control contact 21, 22 is arranged in each of the chambers of the "H". The two contact springs 21*a* and 21*b* or 22*a* and 22*b* of the control contacts are each separated by a wall with a stop grip for passive contact spring 21*b*, 22*b*. The separating wall 65 embracing at a right angle around the load-contact springs bends away at a right angle from one end of the vertical part of the "H" on the load contact side. The height of the separating wall is selected such that the contact heads of the contact springs are arranged above separating wall 65. The height of the separating wall is increased in between the contacts and effects together with ribs 51 on comb 49 a secure separation of the contacts, so that a voltage difference of, for example, 400V cannot lead to a voltage arc-over between the contacts.

Molds for the production of carrier part 12, which define the above-described separating-wall shape as an intermediate space, engage one another in the region of the contacts of two sides. These molds can be pulled apart in a direction opposite one another from the cast carrier part 12. The fact that all contact springs 21*a* to 25*b* arranged in carrier part 12 are produced from flat sheet-metal material and essentially have no bendings, provides for a relatively rapid and simple adjustment by a slight bending of the contact springs directly over the foot region and provides for constancy in operation. The thickness of fastener parts 73 of the load contacts and fastener parts 74 of the control contacts is doubled in the known manner by folding the sheet. The contact heads 47 are riveted on the contact springs. While illustrated herein in its preferred embodiment as a pin, the fastener part of the present invention is drawn broadly to comprise, but not be limited to, pins, nails, solder, screws, and the like.

A safety relay 11 with at least three forcibly guided (mechanically linked) load contacts 23, 24, 25 and at least one forcibly guided (mechanically linked) control contact 21, 22, is thus utilized for the direct connection of the three phases of a three-phase current supply terminal. For this purpose, the load contacts are separated into chambers by a rectangular separating wall 65 embracing the flat contact springs 23*a*, 23*b*, 24*a*, 24*b*, 25*a*, 25*b*, in order to withstand a relative voltage of, for example, 400 V. Contact springs 23*a*, 23*b*, 24*a*, 24*b*, 25*a*, 25*b* are formed with a contact head 47 and a spring foot supported in carrier part 12, wherein the load contacts 23, 24, 25 are designed thicker than control contacts 21, 22. The spring foot 67of the load contact is provided with two fastener parts 73, and is arranged peripherally, but contact head 47 is arranged centrally relative to relay carrier part 12. While the invention has been described above with reference to specific embodiments thereof, it is apparent that many changes, modifications, and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A safety relay comprising:

an electrically insulating carrier part;

an electromagnetic drive arranged on said carrier part;

at least one control contact arranged on said carrier part;

at least three load contacts arranged on said carrier part, each of said load and control contacts is forcibly guided by a common comb connected with said electromagnetic drive and each load and control having an active and a passive contact spring, each of said contact springs comprising:

a contact head;

a spring foot at a distance from said contact head; and at least one fastener part connected with said spring foot, said contact springs being supported solidly with said spring foot in said carrier part; at least one of said contacts forming a working contact and another one a resting contact;

a rigid stop arranged on said carrier part next to which is located said contact head in the vicinity of one of said contact springs, the other one of said contact springs of said contact engaging said comb in such a way that the movement of said contact spring is mechanically linked with the movements of said comb; and a continuous separating wall forming said rigid stop and meandering around said contact springs of said load contacts in a continuous line passing between adjacent individual contact springs of the load contacts from a first side of the relay to a second opposite side of the relay and passing a first contact spring of a load contact along the second side of the relay, forming a first chamber for the first contact spring of said load contact being open to the second side of the relay and forming a second chamber for the second contact spring of the same contact open to the first side of the relay.

2. The safety relay of claim 1, wherein the active contact spring of said load contact has a long end portion on the head side projecting over said contact head to be engaged into the comb, the passive contact spring of said load contact differing from the active contact spring only by a shorter length of said end portion.

3. The safety relay of claim 1, wherein said rigid stop is formed by a lip on said dividing wall between said contact springs of one of said contacts.

4. The safety relay of claim 1, wherein said dividing wall between said contact springs of the same said contact has the same height as said offsets.

5. The safety relay of claim 1, wherein said spring feet of said contact springs of each one of said load contacts is displaced laterally in the plane of said flat contact spring relative to said contact heads of said load contacts such that said fastener parts of said contact springs of said load contact are arranged at opposite edges of said carrier part while said heads are arranged on a central line in between.

6. The safety relay of claim 1, wherein said control contacts are arranged side by side separated by a partition wall aligned in the direction of motion of said comb.

7. The safety relay of claim 6, wherein said comb has an elongated opening and a comb-side edge of said partition wall extending through said opening.

8. The safety relay of claim 7, wherein said comb side edge of said partition wall is forked forming a channel lengthwise to the direction of motion of said comb, and a cover is provided to said cover reaching into said channel by a rib.

9. The safety relay of claim 1, wherein said continuous separating wall being formed by insulating dividing walls between the contact springs of the load contacts extending from one side of the safety relay to the other side and offsets on the sides of at least one insulating dividing wall, said offsets being bent on one side in one direction and on the other side in the opposite direction and connecting said insulating dividing wall with the adjacent insulating dividing walls.

10. The safety relay of claim 9, wherein insulating dividing walls extending from said spring foot up to vicinity of said contact head, the insulating dividing wall between contact springs of the same contact being shorter than the insulating dividing wall between contact springs of different contacts.

11. The safety relay of claim 10, wherein between said contact head of said contact spring engaging said comb and said dividing wall between adjacent contacts, a cross-piece is formed at said comb overlapping said dividing wall and being aligned parallel to said dividing wall.

12. A safety relay comprising:

an electrically insulating carrier part;

an electromagnetic drive arranged on said carrier part;

at least one control contact arranged on said carrier part;

a row of at least three load contacts arranged on said carrier part, each of said load and control contacts is forcibly guided by a common comb connected with said electromagnetic drive and each load and control having an active and a passive contact spring, each of said contact springs comprising:

a contact head;

a spring foot at a distance from said contact head; and at least one fastener part connected with said spring foot, said contact springs being supported solidly with said spring foot in said carrier part; at least one of said contacts forming a working contact and another one a resting contact;

a rigid stop arranged on said carrier part next to which is located said contact head in the vicinity of one of said contact springs, the other one of said contact springs of said contact engaging said comb in such a way that the movement of said contact spring is mechanically linked with the movements of said comb; and a continuous separating wall forming said rigid stop and passing in a zigzag fashion between said contact springs of the load contacts from one end of the row to the other end of the row of load contacts.

* * * * *